US005641154A

United States Patent [19]

Gysling et al.

[11] Patent Number: 5,641,154

[45] Date of Patent: Jun. 24, 1997

[54] MEDIA FEED MECHANISM WITH ADAPTABLE MEDIA TRAY APPARATUS

[75] Inventors: Peter Gysling; Daniel R. Sammartino, both of Boise, Id.

[73] Assignee: Hewlett-Packard Company, Palo Alto, Calif.

[21] Appl. No.: 431,329

[22] Filed: Apr. 27, 1995

[51] Int. Cl.[6] ..... B65H 3/44; B65H 3/06

[52] U.S. Cl. ..... 271/9.01; 271/117; 271/118

[58] Field of Search ..... 271/9, 9.07, 9.08, 271/9.12, 117, 118

[56] References Cited

U.S. PATENT DOCUMENTS

| | | | |
|---|---|---|---|
| 4,660,820 | 4/1987 | Shino et al. | 271/9 |
| 5,120,040 | 6/1992 | Worley | 271/9 |
| 5,203,552 | 4/1993 | Hoshi et al. | 271/9 |

FOREIGN PATENT DOCUMENTS

| | | | |
|---|---|---|---|
| 370484 | 5/1990 | European Pat. Off. | 271/9.01 |

*Primary Examiner*—William E. Terrell

*Assistant Examiner*—Richard A. Chandler

[57] ABSTRACT

A system for providing a hard copy machine with a variety of cut sheet media trays having differing sheet stack capacities is demonstrated. A tray selector mechanism is provided in the media tray docking bay of the hard copy machine. Each tray is provided with sheet separating and picking devices and an interface coupling for engaging the tray devices to the tray selector mechanism. In the exemplary embodiment, a full height tray, that is one which occupies the entire docking bay, allows a maximum capacity of a single media type to be loaded for use in making hard copies. A number of smaller, lesser capacity trays can be substituted for the full height tray in the docking bay, each having a different media type. The tray selector mechanism is then operative to select between the lesser capacity trays on end user demand. A default position of the tray selector mechanism is provided.

15 Claims, 5 Drawing Sheets

MEDIA FEED MECHANISM WITH ADAPTABLE MEDIA TRAY APPARATUS

BACKGROUND OF THE INVENTION

1. Field of the Invention

The present invention relates generally to hard copy machines and, more specifically, to a media feed mechanism with an apparatus for employing media trays of differing capacities.

2. Description of the Related Art

With the popularization of computers, information processing and dissemination has become a critical factor in a broad spectrum of both business data processing and end user recreational activities. A variety of end-users leads to the need for hard copy machines of differing capabilities. In certain hard copy apparatus markets, the end-user needs are split between large capacity media sheet feeder mechanisms and multiple media type sheet feeder mechanisms. That is, one end-user prefers to have multiple media type sources available (for example, both letterhead and envelopes), while another customer uses only one type of media and wants a much larger load capacity to reduce the amount of time spent refilling the media tray.

With the customer needs split between large capacity and multiple media type sources, the hard copy machine designer and manufacturer is faced with the dilemma of deciding which media tray configuration or configurations will best satisfy the end-user. Product models are designed accordingly. To satisfy both market demands, the designer provides two distinct products, one with a single, large capacity media tray and one with dual, smaller capacity media trays. However, the variable use customer—for example, a law firm which uses vast quantities of legal size paper and occasion transparencies for courtroom presentations—are required to choose between the ever increasing number of available models.

Therefore, there is a need for a media sheet feed mechanism design which is adaptable to multiple media tray sizes.

SUMMARY OF THE INVENTION

In its basic aspects, the present invention provides a media tray selector system for a hard copy machine adapted for use with cut sheet media trays. A receiving mechanism is provided, operatively coupled to the hard copy machine, for alternately receiving at least two first type media trays having first external dimensions or one second type media tray having second external dimensions approximately equal to the combined dimensions of the first media trays, respectively. A selecting mechanism is mounted in the receiving mechanism for alternately selecting the second media tray when inserted into said receiving means or one of the first media trays when inserted into said receiving mechanism. An interfacing mechanism is mounted in each of the first type media trays and the second type media trays, for operatively interfacing each of the first media trays or the second media tray with the selecting mechanism.

It is an advantage of the present invention that it provides a single model hard copy machine with the capability of changing the number and capacity of media sheet feeder sources.

It is another advantage of the present invention that it provides a simple process for switching a hard copy machine from a large capacity media tray configuration to a multiple media tray configuration.

It is still another advantage of the present invention that the cost and reliability control issues are shifted along with the sheet feed mechanism from the hard copy machine to the replaceable media tray devices.

It is yet another advantage of the present invention that it is adaptable to a variety of implementations.

Other objects, features and advantages of the present invention will become apparent upon consideration of the following detailed description and the accompanying drawings, in which like reference designations represent like features throughout the FIGURES.

The drawings referred to in this description should be understood as not being drawn to scale except if specifically noted.

DETAILED DESCRIPTION OF THE INVENTION

Reference is made now in detail to a specific embodiment of the present invention, which illustrates the best mode presently contemplated by the inventor(s) for practicing the invention. Alternative embodiments are also briefly described as applicable.

Figure 1:
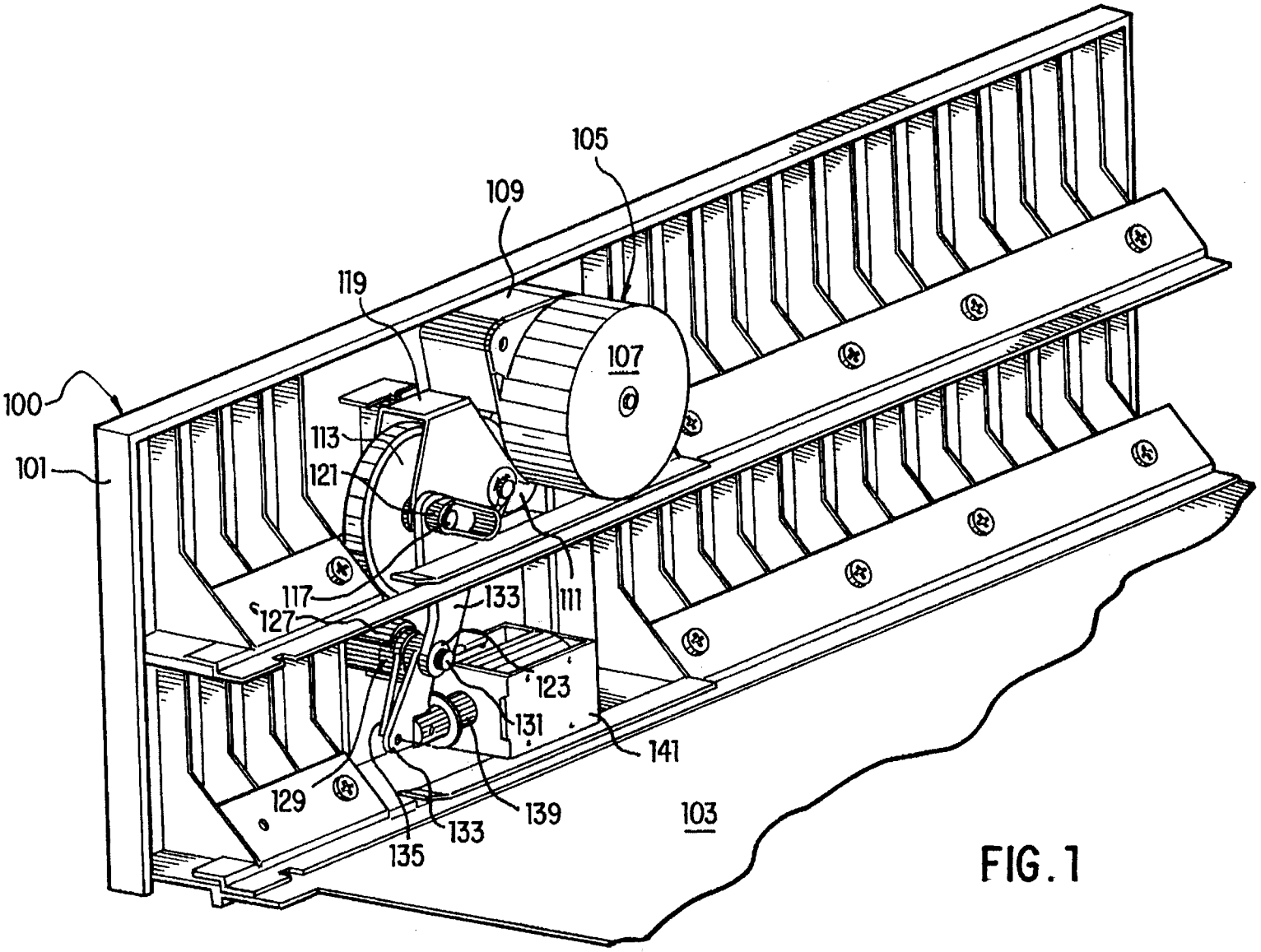
FIG. 1 is a depiction of part of a hard copy machine in perspective view showing a media tray selector mechanism portion of the present invention.

FIG. 1 depicts a portion of the mechanism of the present invention operatively mounted to a media tray frame member 100 of a hard copy machine (not shown). The media tray frame member 100 is essentially a docking bay designed to hold one, full-height, cut sheet media tray or two, half-height, cut sheet media trays. The media tray frame member 100 includes side walls 101, 301 (in FIG. 2 only, transparent view) and a floor 103. The specific implementation can be suited to any particular hard copy machine design expediencies as would be known to a person skilled in the art. Thus, it will be recognized that the adaptive one-tray/two-tray embodiment depicted in the FIGURES is exemplary in nature with respect to such features rather than imposing a limitation on the scope of the invention.

Figure 4:
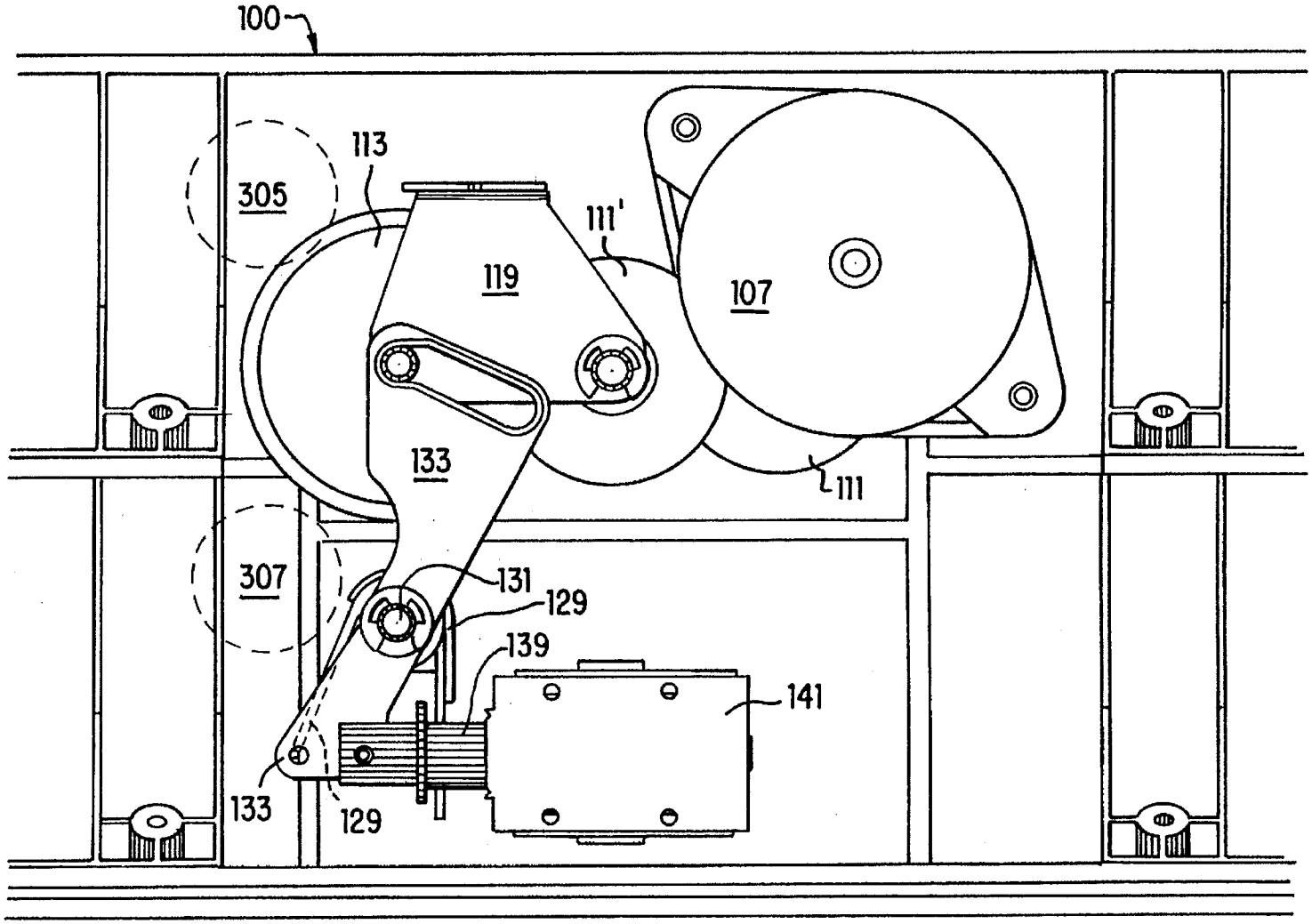
FIG. 4 is a depiction in plan view (side) of the tray selector mechanism portion of FIG. 1 and the gear mechanism portion of FIG. 2 with the tray selector mechanism portion in a first position.
Figure 5:
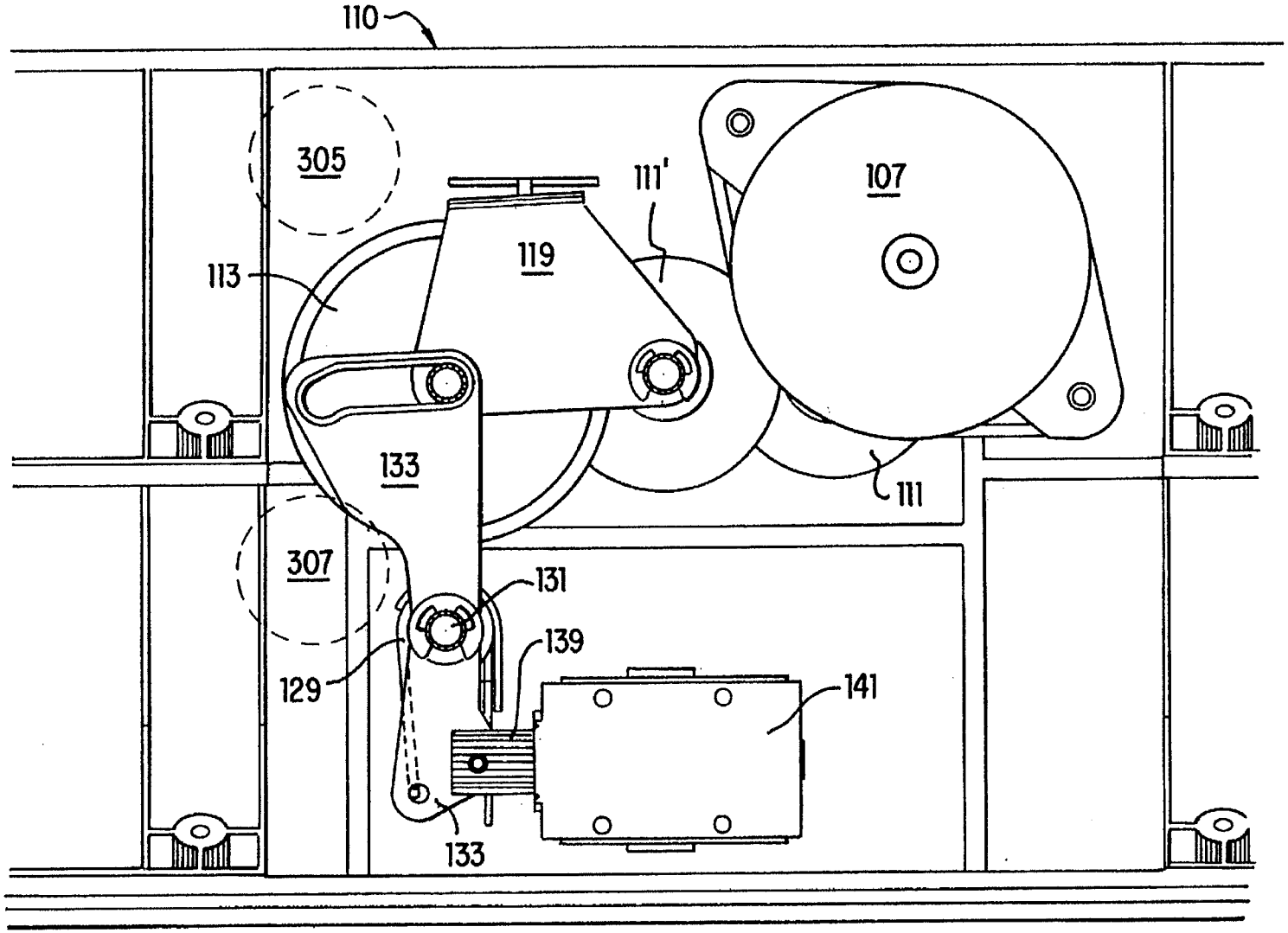
FIG. 5 is a depiction in plan view (side) of the tray selector mechanism portion of FIG. 1 and the gear mechanism portion of FIG. 2 with the tray selector mechanism portion in a second position.

The paper tray selector mechanism 105 is suitably mounted on the frame wall 101. The mounting is designed to provide optimal manufacturing simplicity and appropriate interface capability with media trays in accordance with the present invention. A motor 107 (such as a stepper motor) is affixed to a motor mount 109 attached to the frame wall 101. The motor 107 drives a first gear 111. Referring briefly to FIGS. 4 and 5, appropriate transmission gearing 111, 111' is designed to drive a tray selector gear 113. It should be recognized that this mechanism could be replace by other configurations, such as by having two motors and gear trains, each dedicated to an individual media tray.

As shown in FIGS. 1, 2, 4 and 5, the tray selector gear 113 is rotatably mounted on a cammed pivot mechanism 115. Referring principally to FIG. 1, the tray selector gear 113 has a rotational shaft 117 protruding through a rotatable bracket 119 affixed to the frame side wall 101. The shaft 117 continues through a cam armature 133 and is captured by a cam slide 121 affixed to the cam armature 133. The cam armature 133 is rotatably affixed (such as by a snap ring 123) to a shaft 131 extending from the frame side wall 101. A fixed barrel 127 is part of the frame side wall 101. Within the fixed barrel 127 is a torsion spring 129 and a concentric, internal, shaft 131 protruding from the side wall 101. The cam armature 133 is rotatable on the shaft 131 distally of the cam slide 121. The tray selector gear 113 is thus made selectively positionable as explained in more detail hereinafter.

One end 135 of the torsion spring 129 is coupled to the cam armature 133. The other end of the spring 129 is restrained by the barrel 127. The cam armature 133 is affixed to a solenoid piston 139 distally of the end of the cam armature 133 coupling to the shaft 131. The solenoid piston 139 is, in turn, a slidable solenoid device 141. The solenoid device is of a two-position type, in/out, that would be commercially available and well known in the art.

Figure 2:
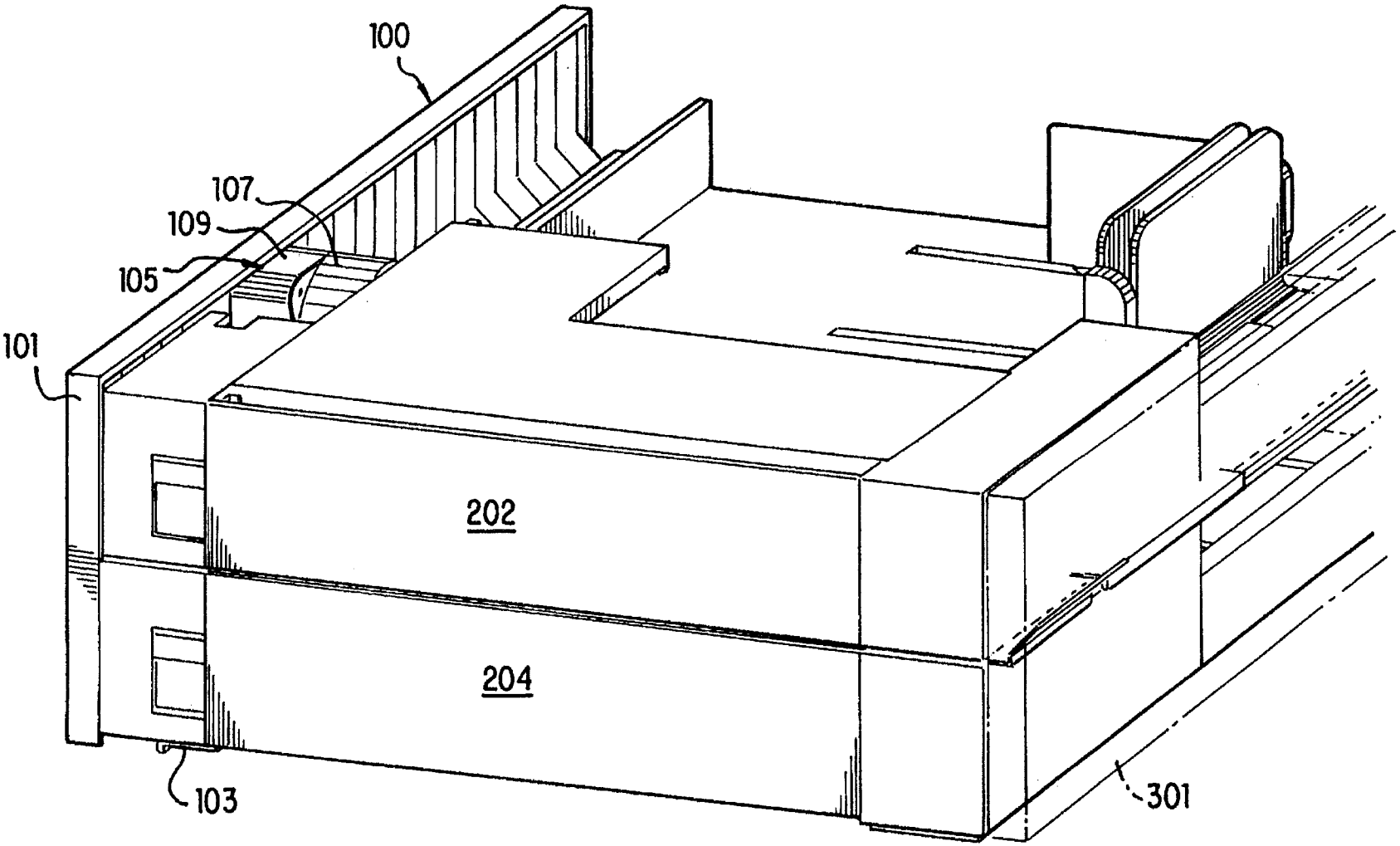
FIG. 2 is a depiction in perspective view of the present invention as shown in FIG. 1 with two, half-capacity media trays inserted.

With the tray selector mechanism 105 deployed as described, FIG. 2 shows the media tray frame member 100 with two "half-capacity" media trays 202, 204 inserted. Basic sheet media tray mechanisms, sheet pick devices, hard copy machine interfacing, and functionality are well known in the art. For example, U.S. Patent application Ser. No. 08/259,768 by Gysling (assigned to the common assignee of the present invention) discloses a type useful in conjunction with the present invention and is incorporated herein by reference in its entirety. Each media tray 202, 204 can be loaded with a supply of different media, e.g., one plain paper, one letterhead (not shown).

It should now be recognized that the present invention includes the ability to remove the two half-capacity media trays 202, 204 and to insert in lieu thereof a single, "full-capacity," media tray (not shown); that is a single media tray of approximately the height of the stacked double tray configuration shown is substituted for the two, half-capacity, media trays 202, 204, thus providing approximately double the sheet media holding capacity for a single type of media, e.g., plain paper.

Figure 3:
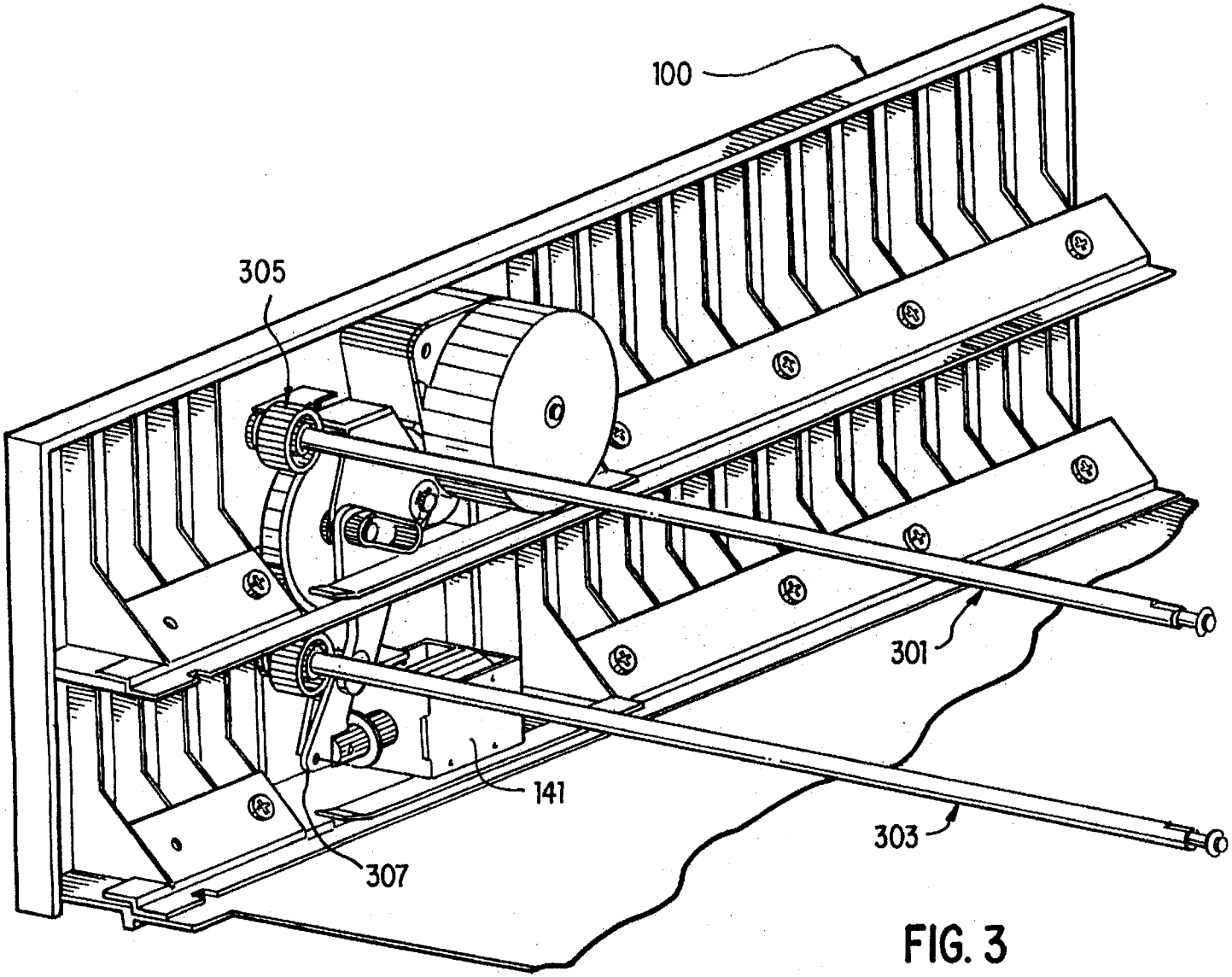
FIG. 3 is a depiction in perspective view of the present invention as shown in FIGS. 1 and 2 showing a gear and input shaft mechanism portion as would be incorporated in a media tray for interfacing with the media tray selector mechanism portion of the present invention.

Turning to FIG. 3, a paper tray 202, 204 to paper tray selector mechanism 102 interface is shown by "removing" all parts of the media trays 202, 204 except for an upper tray 202 interface device 301 and a lower tray 204 interface device 303. Each interface device 301,303 has a drive gear 305,307, respectively, mounted to be engaged by the tray selector gear 113, depending upon the selected position of the tray selector gear 113 using the solenoid device 141. That is, each tray 202, 204 has an interface device 301, 303 device incorporated into the tray apparatus itself. The interface devices would include the essential components for cut sheet print media separation and picking of a single sheet from a stack of cut sheets in the tray, known in the art but generally associated with the hard copy machine apparatus, not the media tray.

For accommodating a single, double-capacity, tray configuration, a default interface is designed; the double-capacity tray would have an identical interface device 301 as the upper half-capacity media tray 202, but no lower interface device at all. Note that the default design can be altered to meet the needs of a specific adaptation of the present invention.

FIG. 4 shows the tray selector mechanism 102 in the default position. Again, all components of the upper and lower trays 202, 204 except the interface devices drive gears 305, 307 (in phantom line) have been deleted to demonstrate the operation of the present invention. The solenoid piston 139 is in its released position and biased by the spring 129, that is, pulled out from the solenoid device 141. With the solenoid piston 139 in this released position, the cam armature 133 descending from the cam pivot shaft 131 has been rotated about the shaft 131 such that the tray selector gear 113 is moved in a vertical direction by the cam slide 121 and the tray selector gear 113 is engaged with the upper tray interface device 301 drive gear 305. That is, the upper tray is "selected."

It should be noted again that a single, double-capacity tray employs the same tray interface device 301 and drive gear 305. Therefore, in the default position, removal of the two half-capacity trays 202, 204 and insertion of a double-height, full-capacity tray automatically engages the tray interface device with the tray selector gear 113.

In the dual tray configuration as shown in FIGS. 4 and 5, the hard copy machine operator now has the capability of selecting one of two media types loaded in the dual trays 202, 204. The selection can be manual, such as by a user interface switch, or the selection can be automated in the program of the host connected to the hard copy machine. For example, working in a word processing program, the user has designated the media to be used to produce a hard copy; the driver control program of the hard copy machine can recognize the designated media type and, if necessary change trays automatically. This is accomplished by activating the solenoid device 141. The solenoid piston 139 will be retracted to the position as shown in FIG. 5. As the solenoid is retracted, it will pull on the cam armature 133 and overcome the bias of the spring 129. The cam armature 133 will rotate about the shaft 131. As the cam armature 133 moves, the tray selector gear 113 rotational shaft 117 is forced by the cam slide 121 in a generally downward trajectory. By the time that the solenoid piston 139 is fully retracted, the upper tray interface device (or single, double-capacity, tray interface device) drive gear 305 has been disengaged from the tray selector gear 113 and the lower tray interface device drive gear 307 has been engaged by the tray selector gear 113. Mechanisms coupled to the tray interface devices 301,303 and thereby to the paper picking devices and the like of the hard copy machine are well-known in the art. Similarly, appropriate electrical interconnects for the apparatus of the present invention are well-known in the art and not critical to an understanding of the present invention.

The foregoing description of the preferred embodiment of the present invention has been presented for purposes of illustration and description. It is not intended to be exhaustive or to limit the invention to the precise form disclosed. Obviously, many modifications and variations will be apparent to practitioners skilled in this art. In particular, it should be noted that the less-than-full-height tray handling can be expanded to three or more trays by such common engineering techniques as adding motors or more complex mechanisms for interfacing the drive motor to additional trays. Similarly, any process steps described might be interchangeable with other steps in order to achieve the same result. The embodiment was chosen and described in order to best explain the principles of the invention and its best mode practical application to thereby enable others skilled in the art to understand the invention for various embodiments and with various modifications as are suited to the particular use contemplated. It is intended that the scope of the invention be defined by the claims appended hereto and their equivalents.

What is claimed is:

1. A media tray selector system for a hard copy machine adapted for use with cut sheet media trays, comprising:

receiving means, operatively coupled to said hard copy machine, for alternatively receiving at least two first said media trays having first external dimensions or one second media tray having second external dimensions approximately equal to the combined dimensions of said first said media trays, respectively;

selecting means, mounted in said receiving means, for alternately selecting said second media tray when inserted into said receiving means or one of said first media trays when said at least two first media trays are inserted into said receiving means;

interfacing means, mounted in each of said first media trays and in said second media tray, for operatively interfacing each of said first media trays or said second media tray with said selecting means; and biasing means for biasing said selecting means to a predetermined position dependent upon which media trays are inserted in said receiving means.

2. The system as set forth in claim 1, wherein said selecting means further comprises:

a motor;

at least one transmitting means, coupled to said motor, for transmitting drive motion generated by said motor;

coupling means, mounted for selective positioning within said receiving means and coupled to said transmitting means, for coupling said transmitting means drive motion to said interfacing means;

positioning means, coupled to said coupling means, for selectively positioning said coupling means to said interfacing means.

3. The system as set forth in claim 1, wherein said biasing means further comprises:

said biasing means biases said selecting means to automatically engage the interfacing means of a predetermined one of said media trays upon insertion of said predetermined one of said media trays into said receiving means.

4. The system as set forth in claim 1, wherein said biasing means, further comprises:

said biasing means biases said selecting means to a position such that said interfacing means of said second media tray is engaged by said selecting means upon insertion of said second media tray into said receiving means.

5. A cut sheet print media selection system for a hard copy machine adapted for using one or more replaceable media trays, comprising:

a media tray docking bay adapted for alternately receiving one full height media tray or a plurality of less than full height media trays;

tray selector apparatus, mounted within said media tray docking bay and adapted for selecting between media trays inserted into said media tray docking bay;

media trays having cut sheet handling devices incorporated therein; and media tray interface apparatus, mounted within each of said media trays, including a device for operatively interfacing said cut sheet handling devices to said tray selector apparatus when a respective media trays is inserted into said media tray docking bay.

6. The system as set forth in claim 5, wherein said tray selector apparatus further comprises:

a motor;

at least one transmission gear, coupled to said motor, for transmitting drive motion generated by said motor;

at least one tray selector gear, mounted for selective positioning within said media tray docking bay and coupled to said transmission gear, thereby coupling said motor to said media tray interface apparatus; and a linkage device, coupled to said tray selector gear, for selectively positioning said tray selector gear such that said media tray interface apparatus of one of said media trays is selectively engaged.

7. The system as set forth in claim 5, further comprising:

a biasing device for holding said tray selector apparatus to a predetermined position.

8. The system as set forth in claim 7, further comprising:

said biasing device automatically engaging the tray selector apparatus of a predetermined one of said media trays upon insertion of said predetermined one of said media trays into said media tray docking bay.

9. The system as set forth in claim 5, further comprising:

said biasing device holding said tray selector apparatus to a default position such that media tray interface apparatus of said second media tray is automatically engaged by said tray selector apparatus upon insertion of said second media tray into said media tray docking bay.

10. A cut sheet media selection and feed system for a hard copy printing and plotting apparatus, comprising:

a frame member of said apparatus adapted to accommodate at least two replaceable cut sheet media trays;

a motor affixed to said frame member;

a tray selector gear mounted to said frame member such that said tray selector gear has a range of predetermined relative motion with respect to said frame member;

at least one transmission gear, coupled to said motor and said tray selector gear for transferring motion from said motor to said tray selector gear;

a tray selector gear positioning mechanism mounted to said frame member and coupled to said tray selector gear such that said mechanism selectively moves said tray selector gear from a first position to a second position across said range of predetermined relative motion; and a plurality of cut sheet media trays, each of said trays having cut sheet media separating and picking mechanisms and an interface device including a transfer gear for coupling said separating and picking mechanisms to said tray selector gear when a tray is operatively inserted into said frame member.

11. The system as set forth in claim 10, wherein at least one of said cut sheet media trays comprises:

a full capacity tray adapted to fit within said frame member and to provide a maximum capacity of a single type of cut sheet media.

12. The system as set forth in claim 11, wherein at least two of said cut sheet media trays comprise:

at least two media trays, having a capacity less than said full capacity tray, adapted to fit within said frame member in combination such that said tray selector gear positioning mechanism is selectively operable to position said tray selector gear at said first position or said second position.

13. The system as set forth in claim 10, further comprising:

a biasing spring for holding said tray selector gear in a predetermined said first position such that the transfer gear of said interface device of a predetermined one of said cut sheet media trays is engaged by said tray selector gear when said predetermined one of said cut sheet media trays is inserted into said frame member.

14. The system as set forth in claim 10, further comprising:

a biasing spring for holding said tray selector gear in a predetermined said first position such that the transfer gear of said interface device of a predetermined one of said cut sheet media trays is engaged by said tray selector gear when said predetermined one of said cut sheet media trays is inserted into said frame member.

15. The system as set forth in claim 13, wherein said predetermined one of said cut sheet media trays further comprises:

a full capacity tray adapted to fit within said frame member and to provide a maximum capacity of a single type of cut sheet media.

* * * * *